United States Patent [19]

Meudec et al.

[11] 4,121,431

[45] Oct. 24, 1978

[54] PROCESS FOR THE REPAIR AND RESTORATION OF ICE TRACKS

[75] Inventors: Henri François Meudec, 36, rue d'Artois, Paris 8, France; Alain Meudec, Chatou, France

[73] Assignee: Henri Francois Meudec, Paris, France

[21] Appl. No.: 814,689

[22] Filed: Jul. 11, 1977

[30] Foreign Application Priority Data

Jul. 13, 1976 [FR] France ..... 76 21446

[51] Int. Cl.[2] ..... F25C 3/02

[52] U.S. Cl. ..... 62/66; 62/273; 252/DIG. 3

[58] Field of Search ..... 62/273, 66; 272/3; 273/1 B; 252/DIG. 3; 427/140; 137/13; 134/100

[56] References Cited

U.S. PATENT DOCUMENTS

| | | | |
|---|---|---|---|
| 1,762,599 | 6/1930 | Thorud | 62/235 X |
| 2,533,878 | 12/1950 | Clark et al. | 137/13 |
| 3,519,006 | 7/1970 | Simon et al. | 137/13 |
| 3,961,639 | 6/1976 | Chang et al. | 137/13 |

*Primary Examiner*—William E. Wayner
*Assistant Examiner*—William E. Tapolcai, Jr.
*Attorney, Agent, or Firm*—Scully, Scott, Murphy & Presser

[57] ABSTRACT

A process for the repair and restoration of ice tracks, preferably for a skating rink, in which an admixture of cold water containing a tensio-active agent miscible in the water is spread on the ice. An antifoam agent is added thereto to prevent the formation of foam in the admixture during mixing and spreading thereof.

11 Claims, No Drawings

PROCESS FOR THE REPAIR AND RESTORATION OF ICE TRACKS

BACKGROUND OF THE INVENTION

1. Field of the Invention

The present invention relates to a new process for the repair or restoration of ice tracks and more particularly, of the tracks in ice-skating rinks.

2. Discussion of the Prior Art

At the present time, there are currently in use two processes for the repair of the ice, particularly ice tracks in skating rinks.

The first of the processes is the repair of the ice with the aid of a machine which, usually, carries out two steps or operations, namely:

1. the planning of the ice,
2. the spreading of water.

The water spread is warm water at a temperature of about 65° C. If cold water were to be used it would not spread it and, as a result, would not stick to the ice. Currently, there are machines in use which permit the water to be sucked up or aspirated in the case where the ice is melted only along the upper surface. This system of suction also allows for the cleaning of the ice before the spreading of the water. The temperature of the ice, depending on the room temperature, is set to between −15° C. and −5° C. In order to repair or restore the ice of a skating rink having surface dimensions of about 30 × 60 meters, it is necessary to spread between 600 and 1,000 liters of water at a temperature of 65° C. This process is quite difficult, and with the net cost being dependent upon the source of the energy which is utilized. The ice, on the average, is renewed or heated four to five times each day depending on the degree of erosion and the public use sessions of the respective ice-skating rink.

The second prior art process is directed at eliminating the need for the spreading of water, but necessitates the utilization of enormous amounts of energy. This process consists of employing a row of gas burners in order to cause plates of steel to become red hot, and then to pass the plates slowly over the ice so as to re-melt the latter on the surface thereof in order to cause the tracks or furrows due to the blades of the ice-skates to disappear.

The drawbacks inherent in this process, colloquially called "iron to iron out," are basically three-fold:

1. the high cost of each operation,
2. the machine which pulls the apparatus must continuously move because of the risk of the ice melting beyond its surface layer or depth. A very large irregularity on the surface of the ice would be caused by stopping the machine at any point,
3. the water never being replenished, the ice tracks contain more and more impurities impeding the "glide" of skates therealong.

The two prior art processes thus have the common characteristic of requiring a rather large consumption of energy. The present invention has for its object first to eliminate all consumption of energy, in other words, to repair the ice with the aid of cold water.

SUMMARY OF THE INVENTION

The invention has as its primary object a simple and unique process for improving the quality of the ice.

As indicated herein above, until the present time it has been impossible to repair the ice with cold water because the latter does not spread properly. Three objects have been pursued during investigations and have resulted in the present invention, in effect:

1. to permit the spreading of cold water, from which there is derived a large economy in the saving of energy,
2. to improve the congealing time of the spread water on the ice, which allows for additional savings in energy,
3. and to improve the "glide" properties or characteristics of the ice.

The present invention contemplates adding to the cold water, during the filling of the tank of the distributing or spreading machine, a product permitting the perfect spreading of the cold water, this product neither impeding the solidifying into ice of the water, nor lessening the qualities of the ice.

In order to attain the three above-mentioned objects, the use of products in the class of tensio-active wetting agents has been employed, in other words, the anionics, the non-ionizers, the cations and the tensio-active phosphates.

Among these classes of products, it has been necessary to eliminate all the non-soluble products or those which are only dispersible in water, and finally, to choose among the remainder those which had the best moistening power at low temperatures.

The major drawback of the tensio-active wetting agents lies in that they foam. It is then necessary to use one or several anti-foaming agents which are compatible with the tensio-active base in order that, at the time of the spreading and of the congealing into ice, there no longer remains any trace of foam.

The choice of tensio-active agent, as already indicated, is effectuated commencing with consideration of its moistening or wetting ability, in order that the process be less difficult to implement than the process employing warm water. Preferably, the non-ionic tensio-actives are used because they foam to a lesser extent than do the anionics. These tensio-active non ionics are either aliphatic polyethers or are derived from synthetic alcohol having a weak foaming ability, and to which there is added an antifoaming agent.

The invention has as an object a process for the repair or restoration of the tracks on ice, this process being characterized in that there is spread on the ice cold water containing 0.0025 to 0.1% and, more particularly, 0.005 to 0.01% by weight of a tensio-active agent which is soluble or miscible in water and, if necessary, an anti-foam agent in a sufficient quantity to avoid any formation of foam during the making of the mixture or during the spreading.

Preferably, in conjunction with the invention process, the tensio-active agent is a non-ionic tensio-active agent.

The non-ionic tensio-actives are, for instance, the products resulting from the reaction of a hydrophobic material such as an alkylphenol, an alkylcreosol or an aliphatic alcohol with several molecules of ethyl oxide or of propylene oxide. Generally, the aliphatic chain of the hydrophobic material contains from eight to ten atoms of carbon.

The sources for the obtention of such tensio-active non-ionic agents are described, for example, in publications relating to tensio-active agents.

Among the tensio-active agents which are preferred in the process, there are mentioned the primary alcohols with chains of ethoxyls, such as CEMULSOL DB-311, commercially sold by Rhone Progil, CEMULSOL FM-33 sold by Melle-Bezones, and the nonylphenoxypoly (ethylenoxy) ethanol having the Formula I:

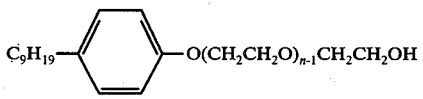

in which $n$ is a variable number of from 6 to 15, and preferably from 8 to 15.

Among these nonylphenolic polyethoxyls one can particularly cite the compounds sold by GAF under the trademark "ANTAROX CO", as well as ANTAROX CO-610, -630, -710 and -730, or sold by Rhone Poulenc under the trademark "CEMULSOL NP," for example, CEMULSOL NP 10 or NP 12.

One can use equally as well as non-ionic tensio-actives, the modified aliphatic polyether, such as "ANTAROX BL-225," sold by GAF.

As antifoam agents, one can use, for example, CEMULSOL NP 2 which is a nonylphenolpolyethoxyl in conformance with the preceding Formula I, with $n=2$, or L'ANTAROX CO-210 (GAF) which is a nonylphenolpolyethoxyl of the Formula I, with $n=1.5$.

The usable antifoam agents, similarly, can be chosen from among those with a silicone base, for example, of the dimethylpolysiloxane type. Among the antifoam agents with a usable silicone base, there can be cited, for example, the compounds sold under the commercial name RHODORSIL by Rhone Poulenc, and in particular, RHODORSIL 424, 426, 426-R.

The content of the antifoam agent in the water which is to be spread varies generally from 0 to 0.01% and, more particulary, from 0.002 to 0.005% by weight, in proportion to the total weight of the spreading mixture.

It has been observed that particulary satisfactory results are obtained when using within the limits indicated above, the combination of two antifoam agents. One part thereof may be a nonylphenolpolyethoxyl in conformance with the preceding Formula I, with $n$ being able to vary from 1.5 to 2, and the other part an antifoam agent having a silicone base.

The antifoam agent with the base of nonylphenolpolyethoxyl ($n=1.5$–2) is used in a proportion not exceeding 60% of the weight of the tensio-active agent.

It should be noted that, due to the process of the invention, the time of the water congealing into ice is very appreciably improved: for a steady room temperature of 8° C. and a steady ice temperature of −6° C., the congealing time with warm water without tensio-actives added thereto is 35 minutes, whereas the congealing time with cold water containing the tensio-active agent is 15 minutes, the spreading having been effected in both cases for 900 liters of liquid spread on a track of an area of 56m × 26m.

It has been observed that the restored ice according to the process of the invention is more resistant on account of a steady ice temperature and a steady room temperture, with the result that the temperature of the ice, due to a steady room temperature, can be raised about 2° without, however, harming the solidity of the ice, so as to result in economy or saving of energy.

The snow produced by the wear and tear of the new ice is much finer and additionally slippery and non-sticking. In addition to a very good spreading of water, one obtains an ice where the "glide" is very clearly improved.

In summation, the invention relates, on the one hand, to the domain of ice-skating rinks, a solution of the saving of energy employed for the repair of the ice and for the maintaining of its temperature and, on the other hand, to an improvement in the solidity and the "glide" property of the ice.

The process of the invention can quite similarly be applied to the repair or restoration of the tracks of ice employed for tobogganing and for the bobsled.

At the present time, the ice tracks for tobogganing and the bobsled are set in ice and kept in repair with cold water.

This water is sprayed through a "little ice pistol." The process of the invention allows for the prevention of the formation of surface irregularities which, in this case, are very numerous and also extremely dangerous. The repaired tracks, according to the process of the invention, allow for greater speeds to be attained without, however, increasing any risks. The proportions of the tensio-active and antifoam products utilized are about the same as for the repair of the ice tracks of an ice-skating rink.

The following examples illustrate the invention without, however, being limitative thereof:

EXAMPLE 1

The following premixture has been prepared:

| | |
|---|---|
| Cemulsol NP 10 | 50 $cm^3$ |
| Cemulsol Np 2 | 30 $cm^3$ |
| Rhodorsil 426 R | 20 $cm^3$ |
| Water | 900 $cm^3$ |

This solution of 1 liter in volume is introduced into the chamber of the ice mending or repairing machine before filling this chamber with cold water in a sufficient quantity to obtain 1000 liters of spreading mixture. At the time of the spreading of water no bubbles appeared and a very good spread was obtained, distinctly superior to the spread obtained with warm water.

EXAMPLE 2

A premixture has been prepared having the following composition:

| | |
|---|---|
| Cemulsol NP 10 | 50 $cm^3$ |
| Cemulsol NP 2 | 30 $cm^3$ |
| Rhodorsil 424 | 0.5 $cm^3$ |
| Water | 920 $cm^3$ |

Upon adding a sufficient quantity of cold water, one obtains 1000 liters of completed spreading mixture.

EXAMPLE 3

In the same manner as above, 1 liter of the following premixture is prepared:

| | |
|---|---|
| Cemulsol FM 33 | 80 $cm^3$ |
| Rhodorsil 426 | 20 $cm^3$ |
| Water | 900 $cm^3$ |

Upon adding the cold water to the premixture, one has prepared 1000 liters of final spreading mixture.

EXAMPLE 4

In the same manner as above, 1 liter of the following premixture is prepared:

| | |
|---|---|
| Cemulsol FM 33 | 80 $cm^3$ |
| Rhodorsil 426 | 40 $cm^3$ |
| Water | 880 $cm^3$ |

This premixture blended with 999 liters of water gives 1000 liters of spreading mixture.

EXAMPLE 5

The following premixture has been prepared:

| | |
|---|---|
| Cemulsol DB 311 | 50 $cm^3$ |
| Cemulsol NP 2 | 30 $cm^3$ |
| Rhodorsil 426 R | 20 $cm^3$ |
| Water | 900 $cm^3$ |

By adding cold water to this premixture 1000 liters of completed spreading mixture has been prepared.

EXAMPLE 6

The following premixture has been prepared:

| | |
|---|---|
| Antarox BL-225 | 100 $cm^3$ |
| Rhodorsil 426 R | 20 $cm^3$ |
| Water | 880 $cm^3$ |

Upon adding a sufficient quantity of cold water, one obtains 1000 liters of completed mixture for spreading.

EXAMPLE 7

The following premixture is prepared:

| | |
|---|---|
| Cemulsol NP 12 | 50 $cm^3$ |
| Cemulsol NP 2 | 30 $cm^3$ |
| Rhodorsil 426 R | 20 $cm^3$ |
| Water | 900 $cm^3$ |

Upon adding a sufficient quantity of cold water, one obtains 1000 liters of completed mixture for spreading.

What is claimed is:

1. Process for repairing or restoring ice tracks, comprising spreading on the ice an admixture of cold water containing from 0.0025 to 0.1% and, more particularly, from 0.005 to 0.01% by weight of a tensio-active agent miscible in water, and an antifoam agent in quantity sufficient to prevent the formation of any foam during tne mixing of the admixture and the spreading thereof and thereafter freezing the admixture.

2. Process as claimed in claim 1, said tensio-active agent comprising a non-ionic tensio-active agent.

3. Process as claimed in claim 1, said tensio-active agent being an alkylphenol.

4. Process as claimed in claim 1, said tensio-active agent being an alkylcreasol.

5. Process as claimed in claim 1, said tensio-active agent being an aliphatic alcohol polyetherized by ethylene oxide or propylene oxide.

6. Process as claimed in claim 3, said tensioactive agent being a nonylphenol polyoxyethylene of the Formula I:

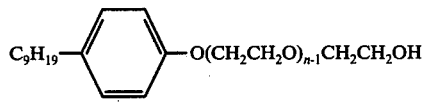

in which $n$ is a number which can vary from 6 to 15 and, preferably, from 8 to 15.

7. Process as claimed in claim 2, said tensio-active agent being a modified aliphatic polyether.

8. Process as claimed in claim 1, comprising a proportion of antifoam agents varying from 0 to 0.01% being used and, more particularly, from 0.002 to 0.005% by weight in proportion to the total weight of the admixture being spread.

9. Process as claimed in claim 1, said antifoam agent containing a nonylphenol polyethoxyl having the formula

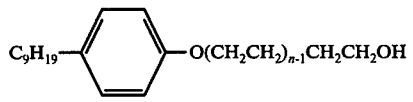

in which $n$ varies from 1.5 to 2.

10. Process as claimed in claim 1, said antifoam agent comprising an antifoam agent having a silicone base.

11. Process as claimed in claim 10, said antifoam agent having a base of dimethylpolysiloxane.

* * * * *